US009679457B1

(12) United States Patent
Welsh

(10) Patent No.: US 9,679,457 B1
(45) Date of Patent: Jun. 13, 2017

(54) REMOTE ACCESS TO SECURITY SYSTEM AND RETROFITTING EXISTING SECURITY SYSTEM FOR REMOTE ACCESS

(71) Applicant: Protective Resources 316 Inc., Oakville, Ontario (CA)

(72) Inventor: Cory William Welsh, Waterdown (CA)

(73) Assignee: Protective Resources 316 Inc. (CA)

( * ) Notice: Subject to any disclaimer, the term of this patent is extended or adjusted under 35 U.S.C. 154(b) by 0 days.

(21) Appl. No.: 14/744,010

(22) Filed: Jun. 18, 2015

Related U.S. Application Data

(60) Provisional application No. 62/015,013, filed on Jun. 20, 2014.

(51) Int. Cl.

| | |
|---|---|
| ***G08B 13/00*** | (2006.01) |
| ***G08B 13/24*** | (2006.01) |
| ***G08B 25/00*** | (2006.01) |
| ***G08B 17/117*** | (2006.01) |
| ***E05B 43/00*** | (2006.01) |

(52) U.S. Cl.
CPC ..... *G08B 13/2491* (2013.01); *E05B 43/005* (2013.01); *G08B 17/117* (2013.01); *G08B 25/008* (2013.01)

(58) Field of Classification Search
CPC ..... G07C 9/00103; G07C 9/00111; G07C 9/00126; G07C 9/00309; G07C 9/182; G08C 17/02; G08B 17/117; E05B 43/005
USPC ..... 340/5.61, 5.64, 5.51, 5.71, 5.26, 5.23, 340/531, 540, 686.6, 541, 521
See application file for complete search history.

(56) References Cited

U.S. PATENT DOCUMENTS

| | | | | | |
|---|---|---|---|---|---|
| 4,360,801 | A * | 11/1982 | Duhame | G08B 17/117 | 318/16 |
| 4,408,251 | A * | 10/1983 | Kaplan | G07C 9/0069 | 307/10.4 |
| 4,433,274 | A * | 2/1984 | Duhame | G08B 17/117 | 318/16 |
| 4,464,651 | A * | 8/1984 | Duhame | G08B 17/117 | 318/16 |
| 5,731,756 | A * | 3/1998 | Roddy | G07C 9/00182 | 340/5.71 |
| 5,872,513 | A * | 2/1999 | Fitzgibbon | E05B 43/005 | 235/382 |
| 6,414,587 | B1 * | 7/2002 | Fitzgibbon | G07C 9/00182 | 340/12.29 |
| 6,437,527 | B1 * | 8/2002 | Rhodes | G07C 9/00182 | 318/264 |
| 6,490,443 | B1 * | 12/2002 | Freeny, Jr. | G06Q 20/32 | 455/406 |

(Continued)

*Primary Examiner* — Hoi Lau
(74) *Attorney, Agent, or Firm* — Steven M. Greenberg; CRGO Law

(57) ABSTRACT

A controller, which can be operated wirelessly by a remote transmitter using PIN-based authentication, has some switch-controlled channels and at least one channel that does not have a corresponding switch. The switch-controlled channels can be used for applications where simple switch-driven manual control is desirable, such as opening and closing a garage using a switch inside the garage (in addition to using the remote transmitter). The channel(s) without switch(es) can be used in applications where simple switch-driven manual control is unwanted and only PIN-authenticated control (e.g. by using the remote transmitter) is desired, such as arming and disarming a home alarm.

13 Claims, 3 Drawing Sheets

(56) References Cited

U.S. PATENT DOCUMENTS 6,983,726 B1 * 1/2006 Luo ..... B60H 1/00314 123/179.2
8,330,570 B2 * 12/2012 Martin ..... G07C 9/00896 340/5.2
8,766,768 B2 * 7/2014 Martin ..... G07C 9/00896 340/5.2
2003/0197595 A1 * 10/2003 Olson ..... G08C 17/02 340/5.61
2005/0024185 A1 * 2/2005 Chuey ..... G08C 17/02 340/5.71
2005/0024229 A1 * 2/2005 Chuey ..... G08C 17/02 340/12.5
2006/0202815 A1 * 9/2006 John ..... G08B 21/14 340/531
2007/0216516 A1 * 9/2007 Ghabra ..... G07C 9/00182 340/5.64
2009/0237204 A1 * 9/2009 Martin ..... G07C 9/00896 340/5.54
2010/0207724 A1 * 8/2010 Morii ..... B60R 25/00 340/5.71
2013/0063259 A1 * 3/2013 Kramer ..... G08C 17/02 340/539.11
2014/0190082 A1 * 7/2014 Sheldon ..... E05F 15/2092 49/30
2014/0266593 A1 * 9/2014 Nye ..... G07C 9/00126 340/5.71
2014/0285316 A1 * 9/2014 Martin ..... G07C 9/00896 340/5.54
2015/0015369 A1 * 1/2015 Lamb ..... E05F 15/77 340/5.71
2015/0048927 A1 * 2/2015 Simmons ..... G07C 9/00309 340/5.61
2015/0179011 A1 * 6/2015 Kramer ..... G07C 9/00896 340/539.11
2015/0302672 A1 * 10/2015 Kalsi ..... G07C 3/00 340/5.61

* cited by examiner

REMOTE ACCESS TO SECURITY SYSTEM AND RETROFITTING EXISTING SECURITY SYSTEM FOR REMOTE ACCESS

CROSS-REFERENCE TO RELATED APPLICATION

This application claims priority to U.S. Provisional Application No. 62/015,013 filed on Jun. 20, 2014, the teachings of which are hereby incorporated by reference.

TECHNICAL FIELD

The present disclosure relates to security systems, and more particularly to remote access to security systems and to retrofitting secured remote access technology to an existing security system.

BACKGROUND

Contrary to stereotype, many criminals are exceptionally clever in their efforts to deprive hard-working people of their property. With the advent of vehicle-carried GPS navigation systems, one recent scheme is to steal a car, enter "home" into the navigation system to locate the vehicle owner's house, and then use a garage door opener in the car to gain access to the garage. With many people leaving the door from the garage to the house unlocked, this strategy can provide easy access to a dwelling.

U.S. Pat. Nos. 8,330,570 and 8,766,768 and U.S. Patent Application Publication No. 2014/0285316 to Albert Martin teach retrofitting a garage door control system to use a remote transmitter with a keypad. The remote transmitter will only transmit a signal to open the garage door if the user enters the correct alphanumeric code or PIN. Martin teaches easy retrofitting to an existing garage door opening system by replacing the existing manually actuable interior switch with a controller that can receive signals from the remote transmitter; the wires are disconnected from the original switch and connected to the controller. When a signal is received from the remote transmitter, the controller sends a switch signal, via the original wires, to the garage door control system to open or close the door. The controller also includes a physical switch to enable the garage door to be manually controlled so that there is no loss of functionality resulting from disconnecting the original switch. While this arrangement will provide considerable target-hardening against use of a garage door remote transmitter to gain access to a home, it does not interface directly with a home alarm system.

SUMMARY

A controller, which can be operated wirelessly by a remote transmitter using PIN-based authentication, has some switch-controlled channels and at least one channel that does not have a corresponding switch. The switch-controlled channels can be used for applications where simple switch-driven manual control is desirable, such as opening and closing a garage using a switch inside the garage (in addition to using the remote transmitter). The channel(s) without switch(es) can be used in applications where simple switch-driven manual control is unwanted and only PIN-authenticated control (e.g. by using the remote transmitter) is desired, such as arming and disarming a home alarm (if the alarm could be controlled by a simple switch, it would be too easy for a criminal to disarm it once inside the garage).

In one aspect, a security system comprises an intrusion control panel, at least one wireless remote transmitter, and a controller. The intrusion control panel is coupled to at least one alarm sensor. Each wireless remote transmitter comprises a keypad adapted for entering an authorization code and transmitter circuitry adapted to transmit wireless command signals to the controller only following entry of a correct authorization code using the keypad. The controller comprises a wireless receiver adapted to receive the wireless command signals, a plurality of output channels, control circuitry adapted to transmit control signals on respective ones of the output channels in response to the wireless receiver receiving the wireless command signals, and at least one externally actuable physical switch. The wireless command signals include alarm command signals for arming and disarming the security system and each wireless command signal corresponds to one of the output channels. The output channels comprise at least one switch-controlled output channel coupled to a respective one of the at least one physical switch, and at least one switch-isolated output channel unresponsive to the externally actuable physical switch(es). The controller is further adapted to transmit a switch-generated control signal on the switch-controlled output channel in response to activation of the corresponding switch. One of the switch-isolated output channel(s) is coupled to the intrusion control panel for controlling the intrusion control panel to arm and disarm the security system in response to the alarm command signals while the intrusion control panel remains isolated from and uncontrolled by the externally actuable physical switch(es). When the wireless receiver receives an alarm command signal, the control circuitry transmits a corresponding control signal to the intrusion control panel via the switch-isolated output channel to arm or disarm the security system.

In one embodiment, the switch-isolated output channel coupled to the intrusion control panel is coupled thereto by wired connection. In another embodiment, the switch-isolated output channel coupled to the intrusion control panel is coupled thereto by wireless connection.

The intrusion control panel may be coupled to the at least one alarm sensor by wired connection or by wireless connection, or by a combination thereof. The alarm sensor(s) may include one or more of a door sensor, a window sensor, a motion sensor, a smoke detector, a heat detector, and a gas detector.

In one embodiment, at least one of the switch-controlled output channel(s) is coupled to a garage door control system and the wireless command signals include at least one garage door command signal. When the wireless receiver receives one of the garage door command signal(s), the control circuitry transmits a corresponding control signal to the garage door control system via the corresponding switch-controlled output channel to control operation of the garage door, and when the physical switch coupled to the corresponding switch-controlled output channel is activated, a switch-generated control signal is transmitted to the garage door control system via the corresponding switch-controlled output channel to control operation of the garage door.

The security system may comprise a user interface panel coupled to the intrusion control panel.

In another aspect, a method of retrofitting an existing installed wired security system comprises disconnecting an existing installed control switch from a garage door control system, coupling a controller to the garage door control system, and coupling the controller to an intrusion control panel of the existing installed wired security system. In this method, the controller comprises a wireless receiver adapted to receive wireless command signals, with the wireless command signals including alarm command signals and garage command signals, at least one externally actuable physical switch, and a plurality of output channels, wherein the output channels comprise at least one switch-controlled output channel coupled to a respective physical switch and at least one switch-isolated output channel unresponsive to the at least one externally actuable physical switch. The controller is adapted to transmit a switch-generated control signal on the switch-controlled output channel in response to activation of the corresponding switch. The controller further comprises control circuitry adapted to transmit control signals on respective ones of the output channels in response to the wireless receiver receiving the wireless command signals. Coupling the controller to the garage door control system comprises coupling one of the at least one switch-controlled output channel to the garage door control system and coupling the controller to the intrusion control panel comprises coupling one of the switch-isolated output channel(s) to the intrusion control panel.

In one embodiment, the controller is coupled to the intrusion control panel by wired connection. In another embodiment, the controller is coupled to the intrusion control panel by wireless connection.

BRIEF DESCRIPTION OF THE DRAWINGS

These and other features will become more apparent from the following description in which reference is made to the appended drawings wherein.

DETAILED DESCRIPTION

Figure 1:
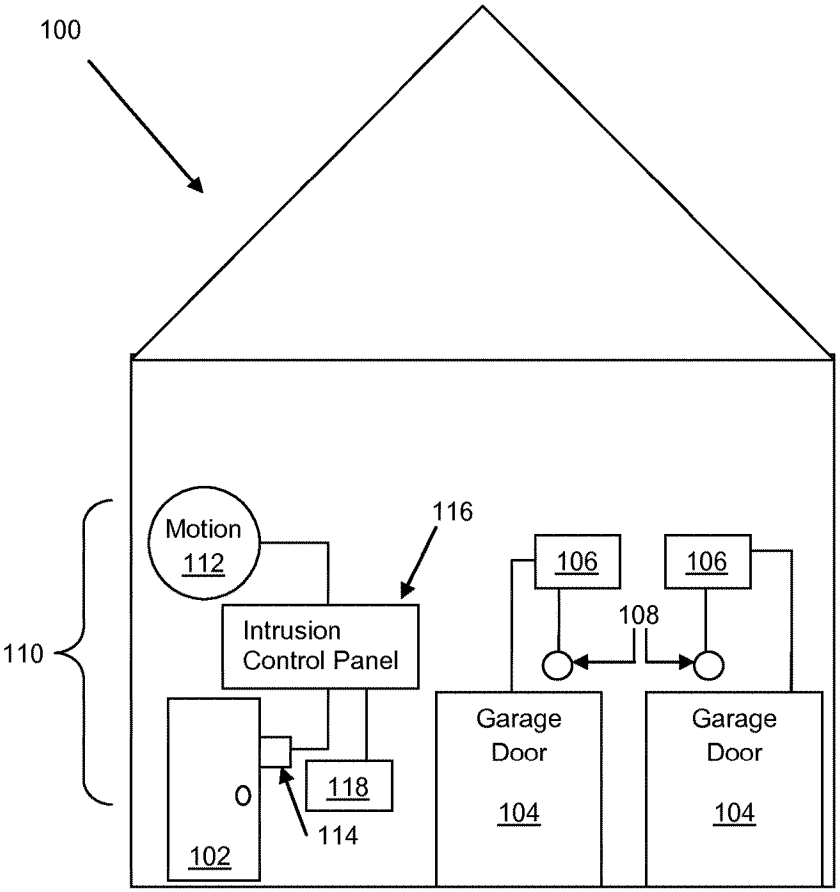
FIG. 1 (Prior Art)
FIG. 1 shows a prior art home with a prior art security system.

Reference is now made to FIG. 1, which shows an exemplary home in the form of a house 100 having a main door 102 and two garage doors 104 which control access to a garage (not shown) having an inner door (also not shown) leading to the interior of the house 100. The garage doors 104 are motor-driven for automatic opening and closing by way of respective garage door control systems 106, as is known in the art and therefore not described in detail. As is conventional, the garage door control systems 106 are responsive to a wireless remote control (not shown) and also to respective hard-wired physical control switches 108 for selectively opening and closing the garage doors 104.

The house 100 also has a security system 110, which comprises a motion sensor 112 and door sensor 114 coupled to an intrusion control panel 116. A user interface panel 118 including a keypad is coupled to the intrusion control panel 116 for providing instructions, such as "arm" and "disarm", to the intrusion control panel 116. The motion sensor 112 and door sensor 114 are merely examples of common types of alarm sensors used in home alarm systems, and a home alarm system may of course include multiple door sensors and/or motion sensors, as well as one or more other types of alarm sensors, such as window sensor(s), smoke detector(s), heat detector(s), gas detector(s), as well as others. The intrusion control panel 116 may be coupled to the alarm sensor(s) 112, 114 and user interface panel 118 by wired connection, by wireless connection, or by a combination thereof. The intrusion control panel 116 may be coupled to a communication interface (not shown) so that it can be remotely monitored, possibly with two-way voice communication, or may simply be connected to a siren or other alarm device. Security systems of the type represented in FIG. 1 are well known in the art and therefore are not described further.

Figure 2:
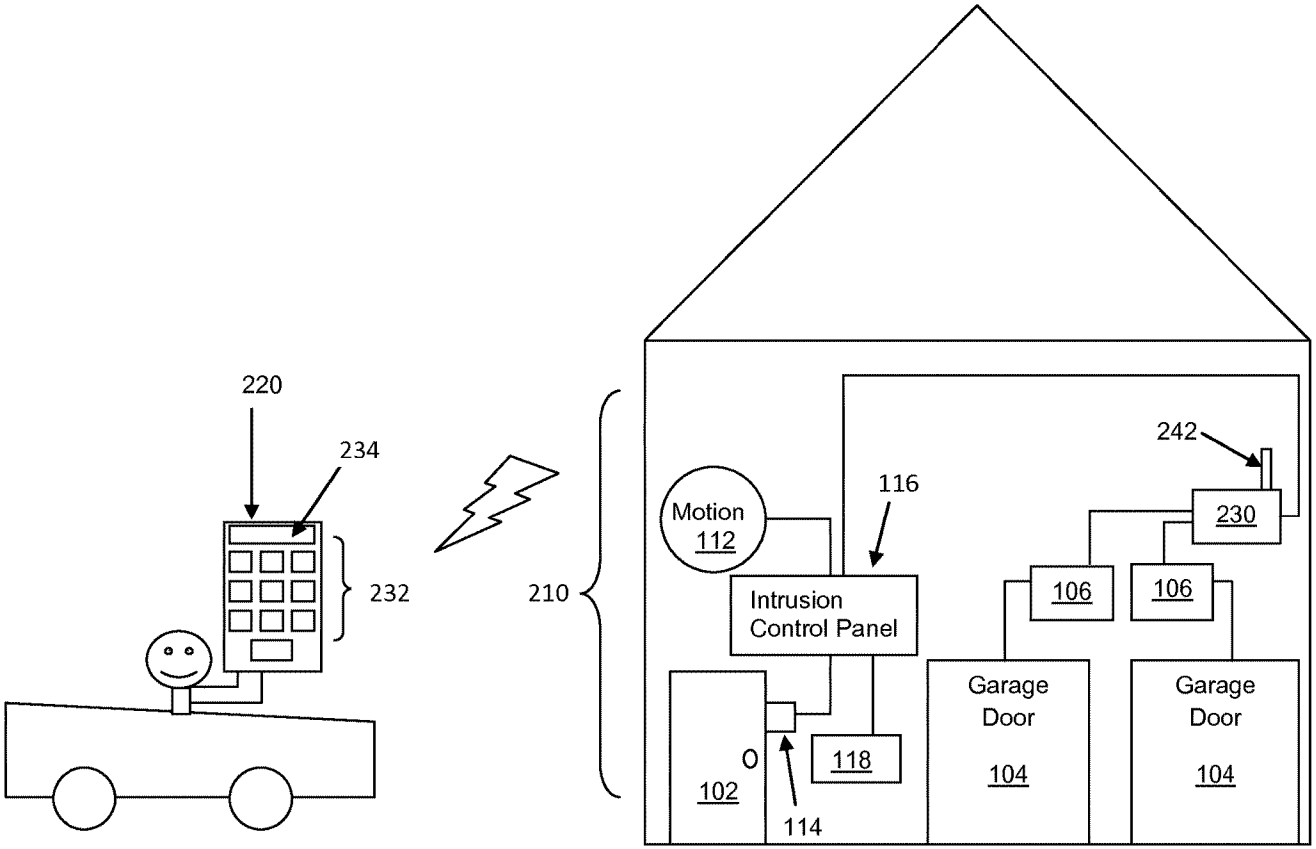
FIG. 2 shows the home of FIG. 1 with an exemplary security system according to the teachings of the present disclosure.
Figure 3:
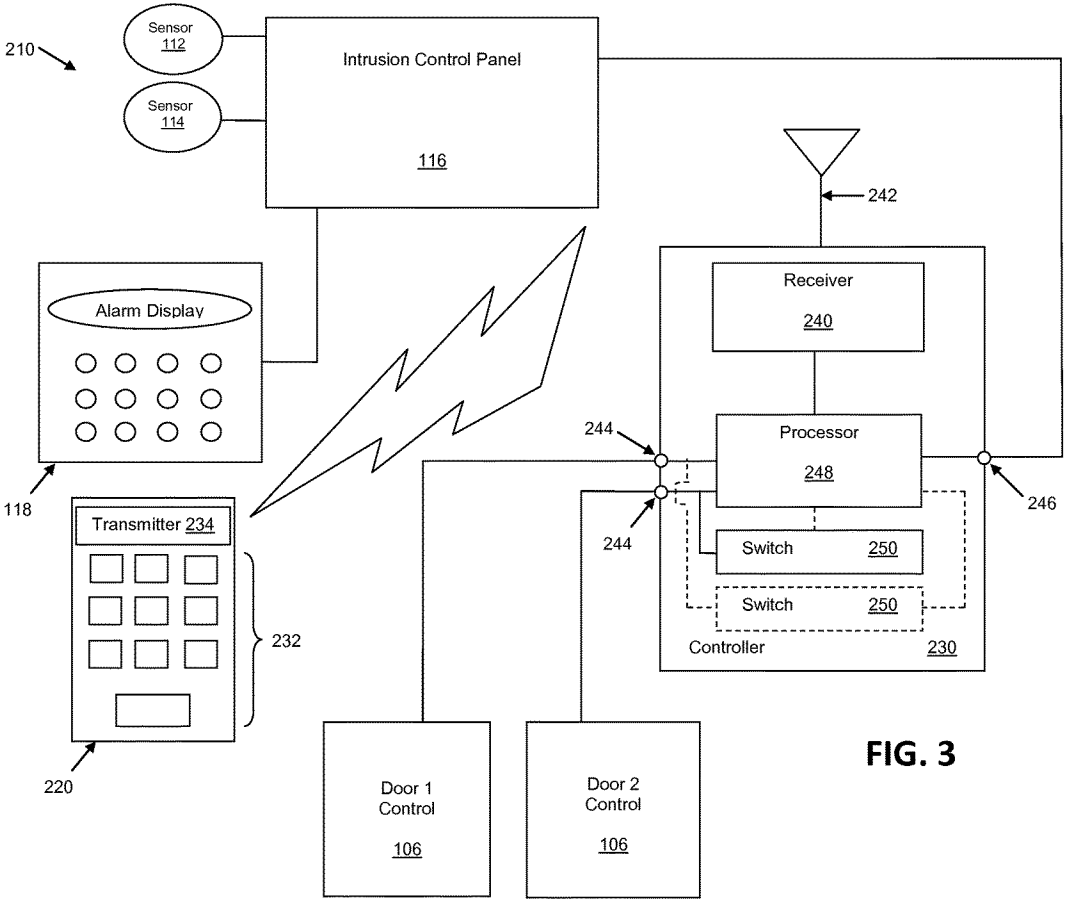
FIG. 3 is a schematic representation of the security system of FIG. 2.

Reference is now made to FIG. 2, which shows the house 100 of FIG. 1 equipped with an exemplary security system 210 according to the present disclosure, and to FIG. 3, which provides additional detail on the security system 210. In one illustrative embodiment, the security system 210 may be obtained by retrofitting the prior art security system 100 shown in FIG. 1, as will be described below.

The security system 210 shown in FIGS. 2 and 3 comprises, in addition to the intrusion control panel 116 and alarm sensors (motion sensor 112, door sensor 114 and possibly others), at least one wireless remote transmitter 220 and a controller 230. As shown in FIG. 3, the wireless remote transmitter(s) 220 each comprise a keypad 232 adapted for entering an authorization code and transmitter circuitry 234 adapted to transmit wireless command signals to the controller only following entry of a correct authorization code using the keypad 232. The wireless command signals include alarm command signals for arming and disarming the security system 210, and may also include signals for causing other actions. The wireless remote transmitter(s) 220 are suitably sized to fit in a pocket or vehicle.

Reference is now made specifically to FIG. 3, in which the exemplary controller 230 is shown in more detail. The controller 230 comprises a wireless receiver 240 including an antenna 242, and the wireless receiver 240 is adapted to receive the wireless command signals transmitted by the wireless remote transmitter(s) 220. The controller 230 further comprises a plurality of output channels 244, 246 (explained further below) and control circuitry adapted to transmit control signals on respective ones of the output channels 244, 246 in response to the wireless receiver 240 receiving the wireless command signals. In the illustrated embodiment the control circuitry is shown as a processor 248; any suitable control circuitry may be used. Each wireless command signal corresponds to one of the output channels 244, 246, so that a particular wireless command signal will designate the output channel 244, 246 on which the corresponding control signal should be sent. The designation could be encoded within the wireless command signal, or could be determined by the processor 248 from the wireless command signal. Preferably, the wireless command signals are encrypted and can be decrypted by the processor 248.

The controller 230 further comprises at least one externally actuable physical switch 250; in the illustrated embodiment an optional second switch 250 is shown with dashed lines. In other embodiments, more than two physical switches may be provided.

The controller 230 has two types of output channel: switch-controlled output channel(s) 244, and switch-isolated output channel(s) 246. The controller 230 has at least one of each type of output channel; in the illustrated embodiment there are two switch-controlled output channels 244 and a single switch-isolated output channel 246 although this is merely one exemplary configuration.

Each switch-controlled output channel 244 is coupled to a respective physical switch 250 in such a way that the controller 230 is adapted to transmit a switch-generated control signal on the switch-controlled output channel 244 in response to activation of the corresponding switch 250. Thus, a user can cause control signals to be sent on respective switch-controlled output channels 244 either by using the wireless remote transmitter(s) 220 to send a wireless command signal or by physically activating the corresponding switch 250. The switch(es) may be coupled directly to the switch-controlled output channel(s) 244, or may be coupled to the processor 248 so as to cause the processor to send the control signals in response to activation of the respective switch 250.

The switch-isolated output channel(s) are unresponsive to the externally actuable physical switch(es); the controller 230 is arranged such that there is no switch that will cause a control signal to be sent on any switch-isolated output channel. Optionally, the controller may be provided with a keypad (not shown) and the processor 248 may be configured to send command signals on the switch-isolated output channel(s) only after correctly entering an alphanumeric code or PIN; this is not considered to be a "switch" as that term is used herein. The term "switch", as used herein, excludes an arrangement in which verification of a user's authorization, such as by way of alphanumeric code, PIN or the like, is required in order to cause a control signal to be transmitted on an output channel. Thus, a "switch", as that term is used herein, refers to an interface that can be used to cause sending of a control signal without knowledge of any security code.

As noted above, the wireless command signals include alarm command signals for arming and disarming the security system 210. As can be seen in FIG. 3, the switch-isolated output channel 246 (or one of them, if there is more than one) is coupled to the intrusion control panel 116 for controlling the intrusion control panel 116 to arm and disarm the security system 210 in response to the alarm command signals. When the wireless receiver 240 receives an alarm command signal, the control circuitry, in this case the processor 248, transmits a corresponding control signal to the intrusion control panel 116 via the switch-isolated output channel 246 to arm or disarm the security system. Because it is only the switch-isolated output channel 246 that is coupled to the intrusion control panel 116, the intrusion control panel 116 remains isolated from, and is not controlled by, the externally actuable physical switch(es) 250. Preferably, the switch-isolated output channel 246 is coupled to the intrusion control panel 116 by wired connection although wireless coupling may also be used.

As noted above, the wireless command signals may include other signals in addition to the alarm command signals for arming and disarming the security system 210. In a preferred embodiment, the switch-controlled output channel(s) 244 are coupled to the respective garage door control systems 106 and the wireless command signals include at least one garage door command signal for opening and closing the garage door(s) 104. When the wireless receiver 240 receives a garage door command signal, the control circuitry, in this case processor 248, transmits a corresponding control signal to the respective garage door control system 106 via the corresponding switch-controlled output channel 244 to control operation of the garage door 104. Similarly, when the physical switch 250 coupled to the corresponding switch-controlled output channel 244 is activated, a switch-generated control signal is transmitted to the garage door control system 106 via the corresponding switch-controlled output channel 244 to control operation of the garage door 104. Thus, a user can control operation of the garage door(s) 104 either by using the wireless remote transmitter(s) 220 or by using the switch(es) 250.

While the controller 230 is shown schematically in FIGS. 2 and 3 as a single unit for purposes of illustration, it is to be appreciated that components of the controller 230 may be physically remote from one another. For example, the controller 230 may comprise a housing (not shown) with a keypad (not shown) coupled to a switch-isolated output channel 246, with the housing and keypad disposed outside of a dwelling or other building. The switch(es) 250 may be disposed inside the dwelling or other building (e.g. inside a garage), remote from the housing and keypad, and coupled by wire or wirelessly to the switch-controlled output channel(s) 244. In such an embodiment, the receiver 240 and processor 248 may be disposed in the housing located outside the building or other dwelling, or may be remote therefrom, for example inside the dwelling or other building to reduce the risk of tampering. Components of the controller 230, for example the receiver 240 and processor 248, may be located in a common housing with the intrusion control panel (e.g. intrusion control panel 116).

As noted above, the security system 210 may be obtained by retrofitting the prior art security system 100 shown in FIG. 1. An exemplary method of retrofitting an existing installed wired security system will now be described. An existing installed control switch, such as one or both of the control switches 108 in FIG. 1, is disconnected from a garage door control system, such as the garage door control system(s) 106 in FIG. 1. A controller, such as the controller 230 shown in FIGS. 2 and 3, is coupled to the garage door control system(s) and to an intrusion control panel, such as the intrusion control panel 116 in FIG. 1, of the existing installed wired security system, such as the security system 110 in FIG. 1. More particularly, coupling the controller to the garage door control system comprises coupling at least one switch-controlled output channel to a corresponding garage door control system and coupling the controller to the intrusion control panel comprises coupling at least one switch-isolated output channel to the intrusion control panel. In one embodiment, the controller is coupled to the intrusion control panel by wired connection. In another embodiment, the controller is coupled to the intrusion control panel by wireless connection. The controller may be mounted to a wall of the garage at or near the location of the original control switch.

It is also contemplated that a security system as described above may be installed as a new security system rather than as a retrofit to an existing security system.

In the illustrated embodiments, the house 100 has two garage doors 104 and each garage door has its own garage door control system 106 including a drive motor (not shown) for raising and lowering the garage doors 104, as is known in the art. Methods and security systems as described herein are also applicable to a house with a single garage door or more than two garage doors, and to an arrangement in which a single garage door control system includes multiple drive motors. Moreover, security systems and retrofitting methods as disclosed herein are not limited to residential applications.

One or more currently preferred embodiments have been described by way of example. It will be apparent to persons skilled in the art that a number of variations and modifications can be made without departing from the scope of the invention as defined in the claims.

What is claimed is:

1. A method of retrofitting an existing installed wired security system, the method comprising:

disconnecting an existing installed control switch from a garage door control system;

coupling a controller to the garage door control system; and coupling the controller to an intrusion control panel of the existing installed wired security system;

wherein the controller comprises:

a wireless receiver adapted to receive wireless command signals, the wireless command signals including alarm command signals and garage command signals;

at least one externally actuable physical switch;

a plurality of output channels, wherein the output channels comprise:

at least one switch-controlled output channel coupled to a respective one of the at least one physical switch, the controller being adapted to transmit a switch-generated control signal on the switch-controlled output channel in response to activation of the corresponding switch;

at least one switch-isolated output channel unresponsive to the at least one externally actuable physical switch; and control circuitry adapted to transmit control signals on respective ones of the output channels in response to the wireless receiver receiving the wireless command signals;

and wherein:

coupling the controller to the garage door control system comprises coupling one of the at least one switch-controlled output channel to the garage door control system; and coupling the controller to the intrusion control panel comprises coupling one of the at least one switch-isolated output channel to the intrusion control panel;

wherein the controller is arranged such that no switch causes a control signal to be sent on any switch-isolated output channel.

2. The method of claim 1, wherein the controller is coupled to the intrusion control panel by wired connection.

3. The method of claim 1, wherein the controller is coupled to the intrusion control panel by wireless connection.

4. A security system, comprising:

an intrusion control panel;

the intrusion control panel being coupled to at least one alarm sensor;

at least one wireless remote transmitter, the at least one wireless remote transmitter comprising:

a keypad adapted for entering an authorization code; and transmitter circuitry adapted to transmit wireless command signals to the controller only following entry of a correct authorization code using the keypad;

a controller, the controller comprising:

a wireless receiver adapted to receive the wireless command signals;

a plurality of output channels;

control circuitry adapted to transmit control signals on respective ones of the output channels in response to the wireless receiver receiving the wireless command signals; and at least one externally actuable physical switch;

wherein the wireless command signals include alarm command signals for arming and disarming the security system;

wherein each wireless command signal corresponds to one of the output channels;

wherein the output channels comprise:

at least one switch-controlled output channel coupled to a respective one of the at least one physical switch, the controller being adapted to transmit a switch-generated control signal on the switch-controlled output channel in response to activation of the corresponding switch;

at least one switch-isolated output channel unresponsive to the at least one externally actuable physical switch;

wherein one of the at least one switch-isolated output channel is coupled to the intrusion control panel for controlling the intrusion control panel to arm and disarm the security system in response to the alarm command signals while the intrusion control panel remains isolated from and uncontrolled by the at least one externally actuable physical switch;

so that, when the wireless receiver receives an alarm command signal, the control circuitry transmits a corresponding control signal to the intrusion control panel via the switch-isolated output channel to arm or disarm the security system;

and wherein the controller is arranged such that no switch causes a control signal to be sent on any switch-isolated output channel.

5. The security system of claim 4, wherein the one of the at least one switch-isolated output channel is coupled to the intrusion control panel by wired connection.

6. The security system of claim 4, wherein the intrusion control panel is coupled to the at least one alarm sensor by wired connection.

7. The security system of claim 4, wherein the intrusion control panel is coupled to the at least one alarm sensor by wireless connection.

8. The security system of claim 4, wherein the one of the at least one switch-isolated output channel is coupled to the intrusion control panel by wireless connection.

9. The security system of claim 8, wherein the intrusion control panel is coupled to the at least one alarm sensor by wired connection.

10. The security system of claim 8, wherein the intrusion control panel is coupled to the at least one alarm sensor by wireless connection.

11. The security system of claim 4, wherein:

at least one of the at least one switch-controlled output channels is coupled to a garage door control system;

the wireless command signals include at least one garage door command signal;

when the wireless receiver receives one of the at least one garage door command signal, the control circuitry transmits a corresponding control signal to the garage door control system via the corresponding switch-controlled output channel to control operation of the garage door; and when the physical switch coupled to the corresponding switch-controlled output channel is activated, a switch-generated control signal is transmitted to the garage door control system via the corresponding switch-controlled output channel to control operation of the garage door.

12. The security system of claim 4, wherein the at least one alarm sensor comprises at least one of a door sensor, a window sensor, a motion sensor, a smoke detector, a heat detector, and a gas detector.

13. The security system of claim 4, wherein the security system comprises a user interface panel coupled to the intrusion control panel.

* * * * *